US005673763A

United States Patent [19]

Thorp

[11] Patent Number: 5,673,763

[45] **Date of Patent: *Oct. 7, 1997**

[54] MODULATED BIAS UNIT FOR ROTARY DRILLING

[75] Inventor: Richard Edward Thorp, Frampton-Cotterell, England

[73] Assignee: Camco Drilling Group Ltd. of Hycalog, Stonehouse Gloucestershire, England

[ * ] Notice: The term of this patent shall not extend beyond the expiration date of Pat. No. 5,553,679.

[21] Appl. No.: 689,632

[22] Filed: Aug. 13, 1996

Related U.S. Application Data

[63] Continuation of Ser. No. 455,270, May 31, 1995, Pat. No. 5,553,679.

[30] Foreign Application Priority Data

Jun. 4, 1994 [GB] United Kingdom ..... 9411228

[51] Int. Cl.[6] ..... E21B 7/08

[52] U.S. Cl. ..... 175/73; 175/61

[58] Field of Search ..... 175/61, 62, 73, 175/75, 324, 393

[56] References Cited

U.S. PATENT DOCUMENTS 5,553,678 9/1996 Barr et al. ..... 175/73
5,553,679 9/1996 Thorp ..... 175/73

FOREIGN PATENT DOCUMENTS 2257182 1/1993 United Kingdom .
2259316 3/1993 United Kingdom .

*Primary Examiner*—William P. Neuder

[57] ABSTRACT

A modulated bias unit, for controlling the direction of drilling of a rotary drill bit when drilling boreholes in subsurface formations, comprises a number of hydraulic actuators spaced apart around the periphery of the unit. Each actuator comprises a movable thrust member which is hydraulically displaceable outwardly and a pivotally mounted formation-engaging pad which overlies the thrust member. An inlet passage supplies fluid under pressure to the chamber, and an outlet passage delivers fluid from the chamber to a lower pressure zone. A selector control valve modulates the fluid pressure supplied to each actuator in synchronism with rotation of the drill bit so that, as the drill bit rotates, each pad is displaced outwardly at the same selected rotational position so as to bias the drill bit laterally and thus control the direction of drilling. The outlet passage from the chamber passes through the thrust member so as to wash the region where the formation-engaging pad overlies the thrust member as the fluid flows to the annulus between the unit and the borehole.

5 Claims, 2 Drawing Sheets

MODULATED BIAS UNIT FOR ROTARY DRILLING

This is a continuation of U.S. Ser. No. 08/455,270, filed May 31, 1995 now U.S. Pat. No. 5,553,679.

BACKGROUND OF THE INVENTION

When drilling or coring holes in subsurface formations, it is often desirable to be able to vary and control the direction of drilling, for example to direct the borehole towards a desirable target or to control the direction horizontally within the payzone once the target has been reached. It may also be desirable to correct for deviations from the desired direction when drilling a straight hole, or to control the direction of the hole to avoid obstacles.

The two basic means of drilling a borehole are rotary drilling, in which the drill bit is connected to a drill string which is rotatably driven from the surface, and systems where the drill bit is rotated by a downhole motor, either a turbine or a positive displacement motor. Hitherto, fully controllable directional drilling has normally required the use of a downhole motor, and there are a number of well known methods for controlling the drilling direction using such a system.

However, although such downhole motor arrangements allow accurately controlled directional drilling to be achieved, there are reasons whey rotary drilling is to be preferred. For example, steered motor drilling requires accurate positioning of the motor in a required rotational orientation, and difficulty may be experienced in this due, for example, to drag and to wind-up in the drill string. Accordingly, some attention has been given to arrangements for achieving a fully steerable rotary drilling system.

For example, British Patent Specification No. 2259316 describes various arrangements in which there is associated with the rotary drill bit a modulated bias unit. The bias unit comprises a number of hydraulic actuators spaced apart around the periphery of the unit, each having a movable thrust member which is hydraulically displaceable outwardly for engagement with the formation of the borehole being drilled. Each actuator has an inlet passage for connection to a source of drilling fluid under pressure and an outlet passage for communication with the annulus. A selector control valve connects the inlet passages in succession to the source of fluid under pressure, as the bias unit rotates. The valve serves to modulate the fluid pressure supplied to each actuator in synchronism with rotation of the drill bit, and in selected phase relation thereto whereby, as the drill bit rotates, each movable thrust member is displaced outwardly at the same selected rotational position so as to bias the drill bit laterally and thus control the direction of drilling.

The present invention provides a number of developments and improvements to the basic type of modulated bias unit to which Specification No. 2259316 relates.

SUMMARY OF THE INVENTION

According to the invention there is provided a modulated bias unit, for controlling the direction of drilling of a rotary drill bit when drilling boreholes in subsurface formations, comprising:

a body structure having an outer peripheral surface;

at least one chamber located adjacent said outer peripheral surface;

inlet means for supplying fluid under pressure to said chamber from a source of fluid under pressure, and outlet means for delivering fluid from said chamber to a lower pressure zone;

a movable thrust member mounted for movement outwardly and inwardly with respect to the body structure, in response to fluid pressure in said chamber;

a formation-engaging member at least partly overlying the thrust member whereby outward movement of the thrust member causes outward movement of the formation-engaging member;

and means for modulating the pressure of fluid supplied to the chamber in synchronism with rotation of the body structure, and in selected phase relation thereto whereby, as the bias unit rotates in use, said formation-engaging member is moved outwardly at a selected rotational orientation of the bias unit;

the aforesaid outlet means including at least one passage extending from said chamber outwardly through said thrust member to deliver fluid to a region where the formation-engaging member overlies the thrust member, so as to wash that region.

Said formation-engaging member may be pivotally mounted on the body structure for pivotal movement about a pivot axis located to one side of said thrust member, whereby outward movement of the thrust member causes outward pivoting movement of the formation-engaging member.

Part of the thrust member may about the formation-engaging member and be otherwise unconnected thereto. In this case one of the thrust member and formation-engaging member may be formed with a projection which engages within a recess in the other member. Said outlet means may include a plurality of passages extending outwardly through the thrust member and having outlets spaced circumferentially apart around said projection.

At least part of said chamber maybe defined by a flexible sealing element connected between the movable thrust member and the body structure of the unit, whereby deformation of the sealing element, as fluid under pressure is supplied to the chamber, allows the thrust member to be urged outwardly in response to said fluid pressure.

In any of the above arrangements said outlet means may comprise a choke aperture communicating with a cavity in the thrust member, and at least one continuation passage extending from the cavity to said region where the formation-engaging member overlies the thrust member, there being provided in the cavity, opposite said choke aperture, an impingement surface formed from superhard material.

The superhard material is preferably polycrystalline diamond, but may also be cubic boron nitride or amorphous diamond-like carbon (ADLC).

For example, the thrust member may incorporate a polycrystalline diamond compact comprising a front table of polycrystalline diamond bonded to a substrate of less hard material, the compact being so located and orientated in the thrust member that the front table thereof provides said impingement surface in said cavity.

The invention also provides a choke device for controlling fluid flow comprising a main body formed with a cavity, a choke aperture communicating with said cavity, and at least one outlet passage extending from the cavity, there being provided in the cavity, opposite said choke aperture, an impingement surface formed from superhard material.

The superhard material is preferably polycrystalline diamond, but may also be cubic boron nitride or amorphous diamond-like carbon (ADLC).

Said outlet passage may extend laterally away from the cavity at an angle to the direction of flow of fluid through the choke aperture, and at a location adjacent said impingement surface.

The main body of the choke device may incorporate a polycrystalline diamond compact comprising a front table of polycrystalline diamond bonded to a substrate of less hard material, the compact being so located and orientated in the main body that the front table thereof provides said impingement surface opposite the choke aperture.

DETAILED DESCRIPTION OF THE PREFERRED EMBODIMENT

Figure 1:
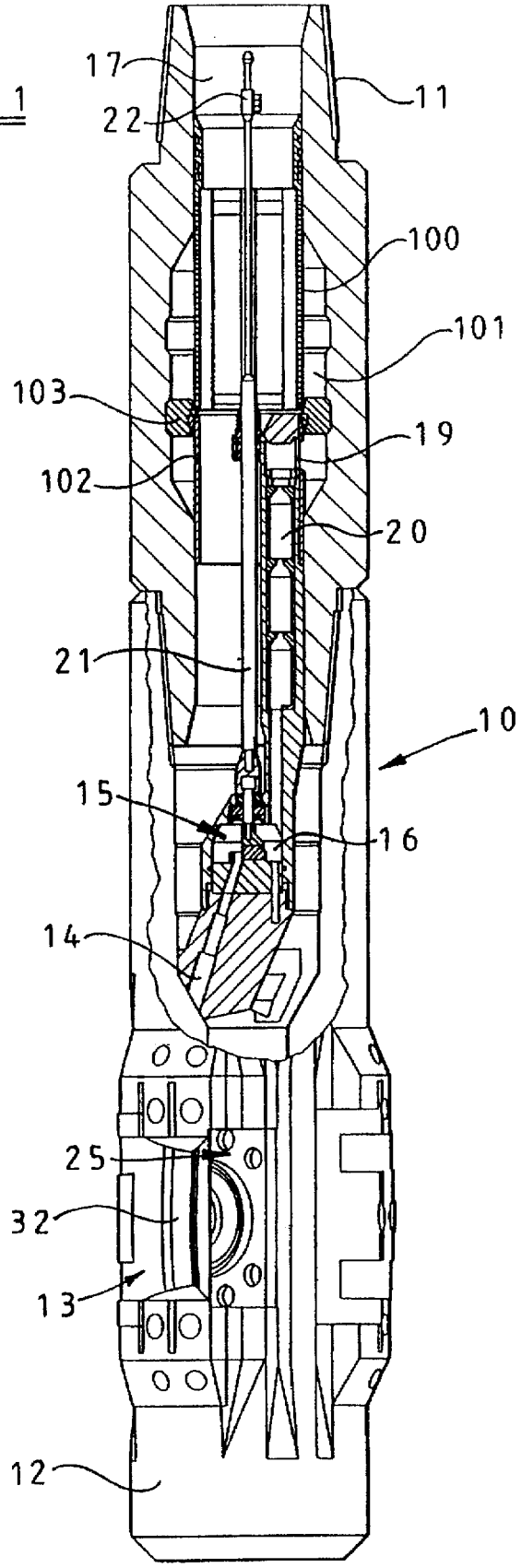
FIG. 1 is a part longitudinal section, part side elevation of a modulated bias unit in accordance with the invention.

Referring to FIG. 1, the bias unit comprises an elongate main body structure 10 provided at its upper end with a tapered externally threaded pin 11 for coupling the unit to a drill collar, incorporating a control unit, for example a roll stabilised instrument package, which is in turn connected to the lower end of the drill string. The lower end 12 of the body structure is formed with a tapered internally threaded socket shaped and dimensioned to receive the standard form of tapered threaded pin on a drill bit. In the aforementioned British Patent Specification No. 2259316 the exemplary arrangement described and illustrated incorporate the modulated bias unit in the drill bit itself. In the arrangement shown in the accompanying drawings the bias unit is separate from the drill bit and may thus be used to effect steering of any form of drill but which may be coupled to its lower end.

There are provided around the periphery of the bias unit, towards its lower end, three equally spaced hydraulic actuators 13, the operation of which will be described in greater detail below. Each hydraulic actuator 13 is supplied with drilling fluid under pressure through a passage 14 under the control of a rotatable disc valve 16 located in a cavity 16 in the body structure of the bias unit.

Drilling fluid delivered under pressure downwardly through the interior of the drill string, in the normal manner, passes into a central passage 17 in the upper part of the bias unit and flows outwardly through a cylindrical filter screen 100 into a surrounding annular chamber 101 formed in the surrounding wall of the body structure of the bias unit. The filter screen 100, and an imperforate tubular element 102 immediately below it, are supported by an encircling spider 103 within the annular chamber 101. Fluid flowing downwardly past the spider 103 to the lower part of the annular chamber 101 flows through an inlet 19 into the upper end of a vertical multiple choke unit 20 through which the drilling fluid is delivered downwardly at an appropriate pressure to the cavity 16.

The disc valve 15 is controlled by an axial shaft 21 which is connected by a coupling 22 to the output shaft (now shown) of the aforementioned control unit (also not shown) in a drill collar connected between the pin 11 and the lower end of the drill string.

The control unit may be of the kind described and claimed in British Patent Specification No. 2257182.

During steered drilling, the control unit maintains the shaft 21 substantially stationary at a rotational orientation which is selected, either from the surface or by a downhole computer program, according to the direction in which the bottom hole assembly, including the bias unit and the drill bit, is to be steered. As the bias unit 10 rotates around the stationary shaft 21 the disc valve 15 operates to deliver drilling fluid under pressure to the three hydraulic actuators 13 in succession. The hydraulic actuators are thus operated in succession as the bias unit rotates, each in the same rotational position so as to displace the bias unit laterally away from the position where the actuators are operated. The selected rotational position of the shaft 21 in space thus determines the direction in which the bias unit is laterally displaced and hence the direction in which the drill bit is steered.

The hydraulic actuators will now be described in greater detail with particular reference to FIG. 2.

Figure 2:
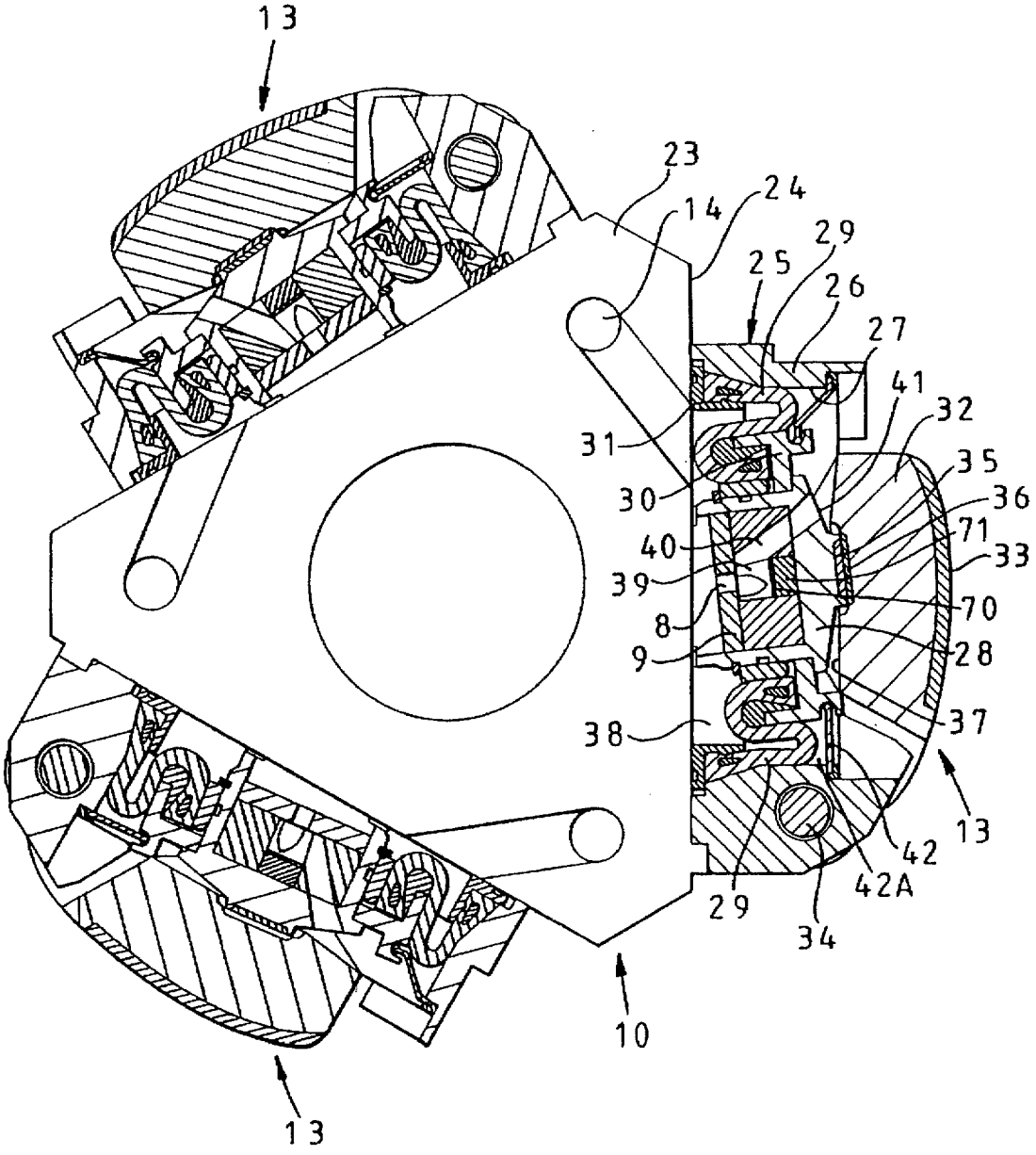
FIG. 2 is a horizontal cross-section through the bias unit, taken along the line 2—2 of FIG. 1.

Referring to FIG. 2: at the location of the hydraulic actuators 13 the body structure 10 of the bias unit comprises a central core 23 of the general form of an equilateral triangle so as to provide three outwardly facing flat surfaces 24.

Mounted on each surface 24 is a rectangular support unit 25 formed with a circular peripheral wall 26 which defines a circular cavity 27. A movable thrust member 28 of generally cylindrical form is located in the cavity 27 and is connected to the peripheral wall 26 by a fabric-reinforced elastomeric annular rolling diaphragm 29. The inner periphery of the diaphragm 29 is clamped to the thrust member 28 by a clamping ring 30 and the outer periphery of the rolling diaphragm 29 is clamped to the peripheral wall 26 by an inner clamping ring 31. The diaphragm 29 has an annular portion of U-shaped cross-section between the outer surface of the clamping ring 30 and the inner surface of the peripheral wall 26.

A pad 32 having a part-cylindrically curved outer surface 33 is pivotally mounted on the support unit 25, to one side of the thrust member 28 and cavity 27, by a pivot pin 34 the longitudinal axis of which is parallel to the longitudinal axis of the bias unit. The outer surface of the cylindrical thrust member 28 is formed with a shallow projection having a flat bearing surface 35 which bears against a flat bearing surface 36 in a shallow recess formed in the inner surface of the pad 32. The bearing surfaces 35 and 36 are hardfaced.

The part of the cavity 27 between the rolling diaphragm 29 and the surface 24 of the central core 23 defines a chamber 38 to which drilling fluid under pressure is supplied through the aforementioned associated passage 14 when the disc valve 15 is in the appropriate position. When the chamber 38 of each hydraulic unit is subjected to fluid under pressure, the thrust member 28 is urged outwardly and by virtue of its engagement with the pad 32 causes the pad 32 to pivot outwardly and bear against the formation of the surrounding borehole and thus displace the bias unit in the opposite direction away from the location, for the time being, of the pad 32. As the bias unit rotates away from the orientation where a particular hydraulic actuator is operated, the next hydraulic actuator to approach that position is operated similarly to maintain the displacement of the bias unit in the same lateral direction. The pressure of the formation on the previously extended pad 32 thus increases, forcing that pad and associated thrust member 28 inwardly again. During this inward movement fluid is expelled from the chamber 38 through a central choke aperture 8 formed in a plate 9 mounted on the thrust member 28, the aperture 8 communicating with a cavity 39. Three circumferentially spaced diverging continuation passages 40 lead from the cavity 39 to three outlets 41 respectively in the outwardly facing surface of the thrust member 28, the outlets being circumferentially spaced around the central bearing surface 35.

Drilling fluid flowing out of the outlets 41 washes over the inner surface 37 of the pad 32 and around the inter-engaging bearing surfaces 35 and 36 and thus prevents silting up of this region with debris carried in the drilling fluid which is at all times flowing past the bias unit along the annulus. The effect of such silting up would be to jam up the mechanism and restrict motion of the pad 32.

The aperture 9 in the plate 8 mounted on the thrust member 28 acts as a choke which causes a substantial drop in fluid pressure. The closed end of the cavity 39 acts as an impingement surface against which the drilling fluid flowing at high velocity through the aperture 9 impinges before being diverted through the angled continuation passages 40.

In order to withstand the high pressure impingement of the abrasive drilling fluid, the impingement surface at the end of the cavity 39 is provided by the polycrystalline diamond facing table 70 of a circular polycrystalline diamond compact 71 which is received and retained within the end of the cavity 39. The provision of the impingement surface allows the cavity to be smaller than would otherwise be the case, and thus provides a choke device which will fit within the limited space available within the thrust member 28.

The compact 71 is an element of a kind which is commonly used as a cutting element in a polycrystalline diamond drag-type drill bit. As is well known, such compacts comprise a facing table of polycrystalline diamond which is bonded to a substrate of less hard material, usually cemented tungsten carbide, in a high pressure, high temperature press.

The choke device provided by the aperture 9, the cavity 39 and impingement surface 70 may also be more widely applicable as a choke device in other circumstances where it is required to effect a substantial drop in fluid pressure in a region where space is severely restricted. The provision of the polycrystalline diamond impingement surface allows rapid deceleration of the fluid flow without resulting in the rapid erosion of the impingement surface which would otherwise occur. Although the use of polycrystalline diamond is preferred, since polycrystalline diamond compacts are readily available, the impingement surface may be formed from any other suitable superhard material, such as cubic boron nitride or amorphous diamond-like carbon (ADLC).

If the rolling diaphragm 29 were to be exposed to the flow of drilling fluid in the annulus, solid particles in the drilling fluid would be likely to find their way between the diaphragm 29 and the surfaces of the members 26 and 30 between which it rolls, leading to rapid abrasive wear of the diaphragm. In order to prevent debris in the drilling fluid from abrading the rolling diaphragm 29 in this manner, a protective further annular flexible diaphragm 42 is connected between the clamping ring 30 and the peripheral wall 26 outwardly of the rolling diaphragm 29. The flexible diaphragm 42 may be fluid permeable so as to permit the flow of clean drilling fluid into and out of the annular space 42A between the diaphragms 29 and 42, while preventing the ingress of solid particles and debris into that space.

Instead of the diaphragm 42 being fluid permeable, it may be impermeable and in this case the space 42A between the diaphragm 42 and the rolling diaphragm 29 may be filled with a flowable material such as grease. In order to allow for changes in pressure in the space between the diaphragms, a passage (not shown) may extend through the peripheral wall 26 of the support unit 25, so as to place the space between the diaphragms 42, 29 into communication with the annulus between the outer surface of the bias unit and the surrounding borehole. In order to inhibit escape of grease through such passage, or the ingress of drilling fluid from the annulus, the passage is filled with a flow-resisting medium, such as wire wool or similar material.

Each rectangular support unit 25 may be secured to the respective surface 24 of the core unit 23 by a number of screws. Since all the operative components of the hydraulic actuator, including the pad 32, thrust member 28 and rolling diaphragm 29, are all mounted on the unit 25, each hydraulic actuator comprises a unit which may be readily replaced in the event of damage or in the event of a unit of different characteristics being required.

Whereas the present invention has been described in particular relation to the drawings attached hereto, it should be understood that other and further modifications, apart from those shown or suggested herein, may be made within the scope and spirit of the present invention.

What is claimed:

1. A choke device for controlling fluid flow comprising a main body formed with a cavity, a choke aperture communicating with said cavity, and at least one outlet passage extending from the cavity, there being provided in the cavity, opposite said choke aperture, an impingement surface formed from superhard material.

2. A choke device according to claim 1, wherein the superhard material is selected from polycrystalline diamond, cubic boron nitride and amorphous diamond-like carbon.

3. A choke device according to claim 1, wherein said outlet passage extends laterally away from the cavity at an angle to the direction of flow of fluid through the choke aperture.

4. A choke device according to claim 3 wherein said outlet passage extends away from the cavity at a location adjacent said impingement surface.

5. A choke device according to claim 1, wherein the main body incorporates a polycrystalline diamond compact comprising a front table of polycrystalline diamond bonded to a substrate of less hard material, the compact being so located and orientated in the main body that the front table thereof provides said impingement surface opposite the choke aperture.

* * * * *